US010380980B2

(12) United States Patent
Laukat et al.

(10) Patent No.: US 10,380,980 B2
(45) Date of Patent: Aug. 13, 2019

(54) BASS CLARINETS, INCLUDING IMPROVEMENTS TO THE REGISTER KEY AND VENT TUBE IN BASS CLARINETS, AND RELATED METHODS

(71) Applicant: Cannonball Musical Instruments, LLC, Sandy, UT (US)

(72) Inventors: Sheryl Laukat, Sandy, UT (US); Tevis Laukat, Sandy, UT (US); John Daron Bradford, Sandy, UT (US); Ryan Lillywhite, Sandy, UT (US)

(73) Assignee: CANNONBALL MUSICAL INSTRUMENTS, LLC, Sandy, UT (US)

( * ) Notice: Subject to any disclaimer, the term of this patent is extended or adjusted under 35 U.S.C. 154(b) by 0 days.

(21) Appl. No.: 15/871,800

(22) Filed: Jan. 15, 2018

(65) Prior Publication Data

US 2018/0204546 A1 Jul. 19, 2018

Related U.S. Application Data

(60) Provisional application No. 62/446,180, filed on Jan. 13, 2017.

(51) Int. Cl.
*G10D 9/04* (2006.01)
*G10D 7/06* (2006.01)

(52) U.S. Cl.
CPC ..... *G10D 9/043* (2013.01); *G10D 7/066* (2013.01)

(58) Field of Classification Search
CPC ..... G10D 9/043; G10D 7/066
See application file for complete search history.

(56) References Cited

U.S. PATENT DOCUMENTS 2,506,489 A * 5/1950 Christensen ..... G10D 7/066 84/382
3,941,026 A * 3/1976 Hildebrandt ..... G10D 7/066 84/382

* cited by examiner

*Primary Examiner* — Kimberly R Lockett
(74) *Attorney, Agent, or Firm* — Scarinci Hollenbeck, LLC

(57) ABSTRACT

Disclosed is a bass clarinet that enables even splitting of the harmonics without compromising the efficacy of the instrument, without increasing manufacturing costs, and without the requirement of a clarinettist relearning how to play the instrument. It is further an object of the disclosure to describe bass clarinets with the ability to change harmonics without requiring the player to compensate with embouchure and air pressure.

4 Claims, 7 Drawing Sheets

FIG. 2

BASS CLARINETS, INCLUDING IMPROVEMENTS TO THE REGISTER KEY AND VENT TUBE IN BASS CLARINETS, AND RELATED METHODS

This application claims priority to provisional patent application No. 62/446,180 filed on Jan. 13, 2017.

BACKGROUND

Field of Invention

The disclosed subject matter is in the field of bass clarinets. In particular, the subject matter described by this paper is in the field of key mechanisms and vent holes for bass clarinets.

Background of the Invention

The bass clarinet woodwind musical instrument is in the clarinet family and defines a single-reeded areophone with keys. Structurally, the bass clarinet is defined by a straight-bodied tube with (a) an upturned metal bell having a curved metal neck at one end plus (b) a crook and a reeded mouthpiece at the other end. At various positions along the body, keyed holes are strategically provided so that musical notes may be produced by passing air into the mouthpiece, through the body, and out of the bell. Basically, the mouthpiece creates a pressure antinode so that air moves harmonically through the tube with pressure nodes preferably occurring at open key holes, wherein the harmonic movement of the air vibrates the metal bell in a manner that produces sounds.

In bass clarinets, each open key hole produces a note with a default harmonic mode or normal mode of the air movement called a register. The default harmonic or normal mode can be changed by manipulating a keyed hole in the body, called the register key and vent tube. Opening the vent tube produces a pressure node that ultimately causes the air to move according to a different harmonic mode than when the vent tube was closed. Although the bass clarinet's register key and vent tube enables use of a different harmonic mode or register for the clarinet's key holes, the register key and vent tube are traditionally put in a fixed position along the body of the clarinet wherein the positioning is meant to evenly split the default harmonic mode or register. This fixed position of the vent tube and register key is necessarily limiting because the farther away an open key hole is from the vent tube the more uneven the split of the key hole's default harmonic mode or register. An uneven split of the harmonic mode or register does not provide optimal intonation. Unfortunately, traditional bass clarinets have a single register key and vent tube such that most bass clarinets play with intonation of approximately 20 cents flat in the lower notes and 20 cents sharp in the upper register requiring the player to compensate with embouchure and air pressure. Hypothetically, there should be a separate register vent tube for every note (key hole) on the bass clarinet so that the harmonics of each note can be split exactly even. Practically though, so many vent tubes on a bass clarinet would compromise the efficacy of the instrument, increase manufacturing costs, and require the relearning of how to play such a complicated instrument.

SUMMARY OF THE INVENTION

In view of the foregoing, an object of this specification is to disclose a bass clarinet that enables even splitting of the harmonics without compromising the efficacy of the instrument, without increasing manufacturing costs, and without the requirement of a clarinetist relearning how to play the instrument. It is further an object of the disclosure to describe bass clarinets with the ability to change harmonics without requiring the player to compensate with embouchure and air pressure. Suitably, disclosed is bass clarinet wherein the first and second register keys and vent tubes are positioned in the traditional locations and wherein a supplementary vent hole and key are positioned adjacent a bell of the clarinet. With such a configuration, intonation can be close to perfect (0 cents flat or sharp). Preferably, an automated mechanism is provided so that the supplementary vent hole key is tied in to a register key and a low E-flat key of the clarinet to facilitate seamless integration of the supplementary vent hole key without requiring extra effort on the part of the user, increased manufacturing costs for the instrument, or loss of efficacy of the instrument.

BRIEF DESCRIPTION OF THE DRAWINGS

Other objectives of the disclosure will become apparent to those skilled in the art once the invention has been shown and described. The manner in which these objectives and other desirable characteristics can be obtained is explained in the following description and attached figures in which.

Figures 1, 2:
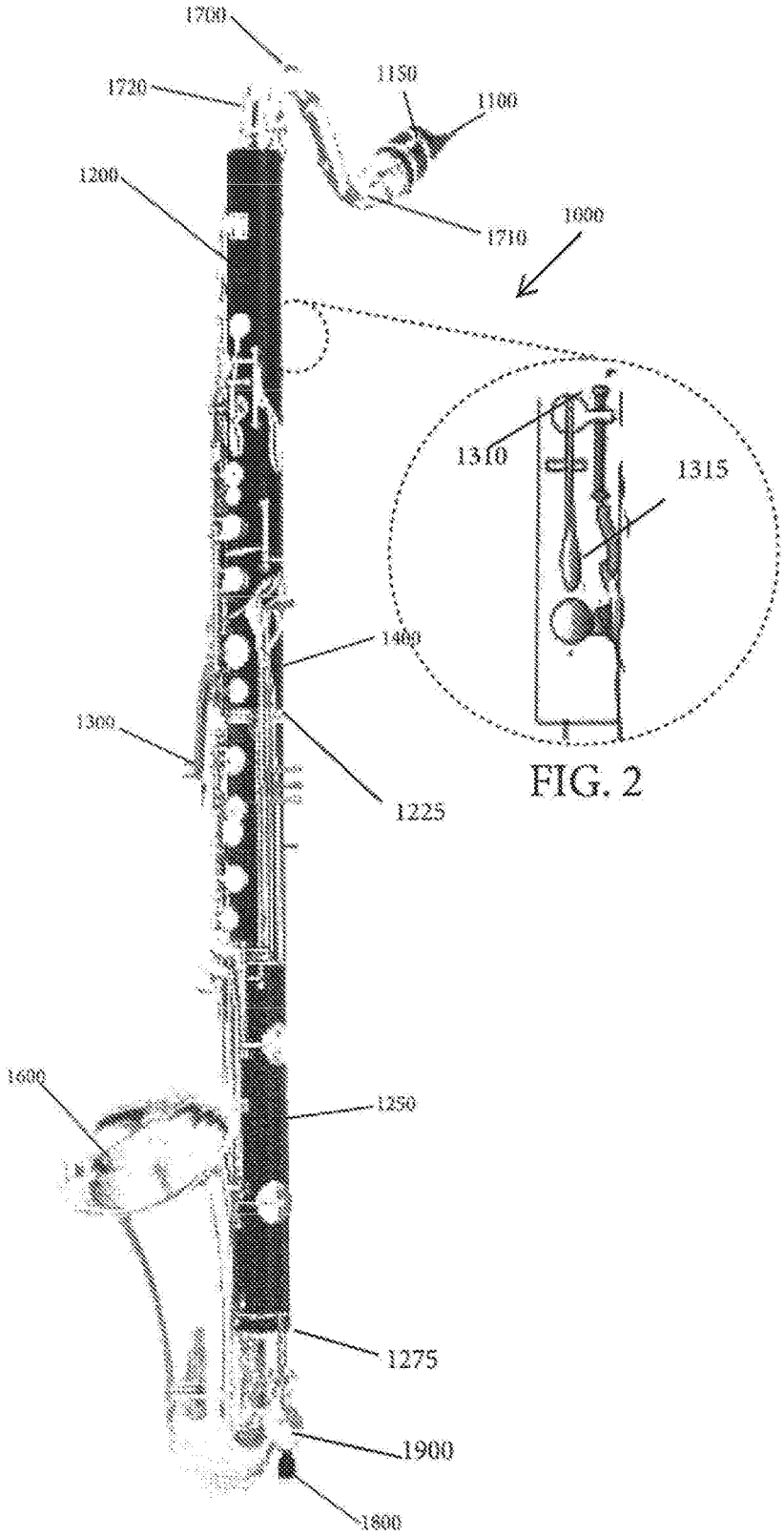
FIG. 1 is a perspective view of a bass clarinet 1000.
FIG. 2 is a zoom in of the register key 1310 and register key control spatula 1315 of a typical bass clarinet 1000.

The reference numerals in the drawings correspond to the following components:

1000—bass clarinet;
1100—mouthpiece;
1150—ligature;
1200—upper joint;
1225—upper connection point;
1250—lower joint;
1275—lower connection point;
1300—keys;
1310—register key;
1400—main body;
1600—bell;
1700—neck;
1710—upper neck;
1720—lower neck;
1800—peg;
1900—low E-flat key;

2000—improved bass clarinet;
2100—mouthpiece;
2150—ligature;
2200—upper joint;
2225—upper connection point;
2250—middle joint;
2275—middle connection point;
2285—lower joint;
2295—lower connection point;
2300—keys;
2310—register key;
2311—register key motion transfer paddle;
2312—control spatula motion transfer paddle;
2313—motion transfer rod upper transfer paddle;
2315—register key control spatula;
2316—upper motion transfer rod;
2317—upper motion transfer paddle;
2318—lower motion transfer paddle;
2319—lower motion transfer rod;
2320—supplementary vent hole key;
2321—supplementary vent hole key motion transfer paddle;
2400—main body;
2600—bell;
2700—neck;
2710—upper neck;
2720—lower neck;
2800—peg;
2900—low E-flat key
2910—low E-flat key motion transfer paddle.

It is to be noted, however, that the appended figures illustrate only typical embodiments of this invention and are therefore not to be considered limiting of its scope, for the invention may admit to other equally effective embodiments that will be appreciated by those reasonably skilled in the relevant arts. Also, figures are not necessarily made to scale but are representative.

DETAILED DESCRIPTION OF THE INVENTION

Disclosed, in general, may be an improved bass clarinet that, unlike traditional bass clarinets, enables even splitting of the instrument's harmonics without compromising the efficacy of the instrument, without increasing manufacturing costs, and without the requirement of a clarinetist relearning how to play the instrument. In one embodiment, the improved bass clarinet suitably features the ability to change harmonics without requiring a player to compensate with embouchure or air pressure. Suitably, disclosed is bass clarinet wherein the first and second register keys and vent tubes are positioned in the traditional locations and wherein a supplementary vent hole and key are positioned adjacent a bell of the clarinet. With such a configuration, intonation can be close to perfect (0 cents flat or sharp). Preferably, an automated mechanism is provided so that the supplementary vent hole key is tied in to a register key and a low E-flat key of the clarinet to facilitate seamless integration of the supplementary vent hole key without requiring extra effort on the part of the user, increased manufacturing costs for the instrument, or loss of efficacy of the instrument.

The present disclosure represents improvements to a typical bass clarinet. As such, initially disclosed is the basic structures of a typical bass clarinet 1000. FIG. 1 is a perspective view of a typical bass clarinet 1000. FIG. 2 is a zoom in of the register key 1310 and register key control spatula 1315 of a typical bass clarinet 1000. As shown in FIGS. 1 and 2 a typical clarinet 1000 comprises a straight-bodied tube 1400 with (a) an upturned metal bell 1600 at one end plus (b) a crook and a reeded mouthpiece 1100 at the other end. At various positions along the body, keyed holes 1300 are strategically provided so that musical notes may be produced by passing air into the mouthpiece 1100, through the body 1400, and out of the bell 1600. Suitably, the clarinet 1000 is constructed of sections, namely the neck 1700 (including upper neck 1710 and lower neck 1720), the upper joint 1200, the lower joint 1250 and the bell 1600. Suitably, a reeded mouthpiece 1100 is coupled to the upper neck 1720, the upper joint 1200 is connected to the lower joint 1250 at an upper connection point 1225, the lower joint 1250 is connected to the bell 1600 at the lower connection point 1275, and a peg 1800 is provided along the lower portion of the instrument 1000 so that the instrument 1000 may be played in an upright position while the peg 1800 is stabilized against a support surface (not shown). A register key 1310 with an associated spatula 1315 for manipulating the key is provided in the upper joint just below the neck 1700 while the bell features a low E-flat key 1900 just below the lower connection point 1275.

Figure 3:
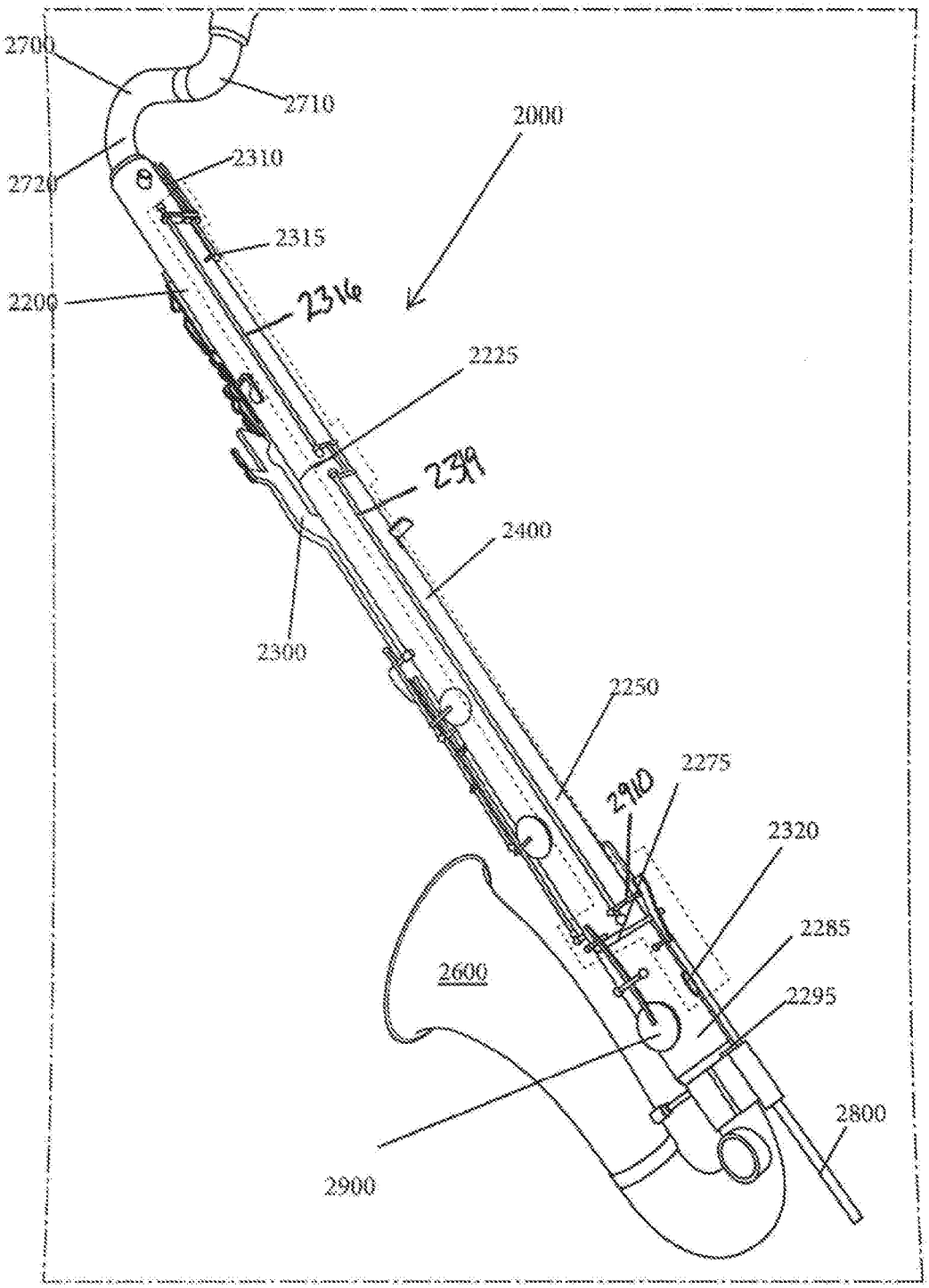
FIG. 3 is a perspective view of an improved bass clarinet 2000.

FIG. 3 is a perspective view of an improved bass clarinet 2000. As shown in FIG. 3, a preferred embodiment of the disclosed clarinet 2000 comprises a straight-bodied tube 2400 with (a) an upturned metal bell 2600 at one end plus (b) a crook and a reeded mouthpiece 2100 (not shown) at the other end. At various positions along the body 2400, keyed holes 2300 are strategically provided so that musical notes may be produced by passing air into the mouthpiece 2100 (not shown), through the body 2400, and out of the bell 2600. Suitably, the clarinet 2000 is constructed of sections, namely the neck 2700 (including upper neck 2710 and lower neck 2720), the upper joint 2200, the middle joint 2250, the lower joint 2285 and the bell 2600. Suitably, a mouthpiece 2100 (not shown) is coupled to the neck 2700, the upper joint 2200 is connected to the middle joint 2250 at an upper connection point 2225, the middle joint 2250 is connected to the lower joint 2285 at a middle connection point 2275, the lower joint 2285 is connected to the bell 2600 at the lower connection point 2295, and a peg 2800 is provided along the lower portion of the instrument 2000 so that the instrument 2000 may be played in an upright position while the peg 2800 is stabilized against a support surface (not shown).

In a preferred embodiment, the disclosed bass clarinet 2000 suitably features a register key 2310 that closes or opens an associated vent tube (not shown) via manipulation of the register key control spatula 2315. The register key 2310 positioned so that the middle register plays in tune just below the neck 2700 of the bass clarinet 2000. Suitably, the preferred embodiment of the bass clarinet 2000 also suitably features a supplementary vent hole key 2320 that closes or opens an associated vent hole (not shown) via either (a) the register key control spatula 2315 or (b) the low E-flat key motion transfer paddle 2910. Suitably, the supplementary vent hole key 2320 may be provided so that the low register plays in tune. With such a configuration, intonation can be close to perfect (0 cents flat or sharp). As discussed below in connections with FIGS. 4A through 10, an automated mechanism is provided so that the supplementary vent hole key 2320 is tied in to the register key 2310 and low E-flat key 2900 of the clarinet to facilitate seamless integration of the supplementary vent hole key without requiring extra effort on the part of the user, increased manufacturing costs for the instrument, or loss of efficacy of the instrument.

As discussed above, the disclosed bass clarinet 2000 suitably features a register key 2310 with an associated spatula 2315 for manipulating the key 2310 in the upper joint 2200 just below the neck 2700, the lower joint features the supplementary vent hole, supplementary vent hole key, and low E-flat key 2900 just below the lower connection point 2275. Upper motion transfer rod 2316 and lower motion transfer rod 2319 along the instrument are provided to connect the control of register key 2310 and supplementary vent hole key 2320 to the register key control spatula 2315. Suitably, a low E-flat key motion transfer paddle 2910 is provided to the control mechanisms of the low E-flat key 2900 and for controlling the supplementary vent hole key 2320.

Figure 4A:
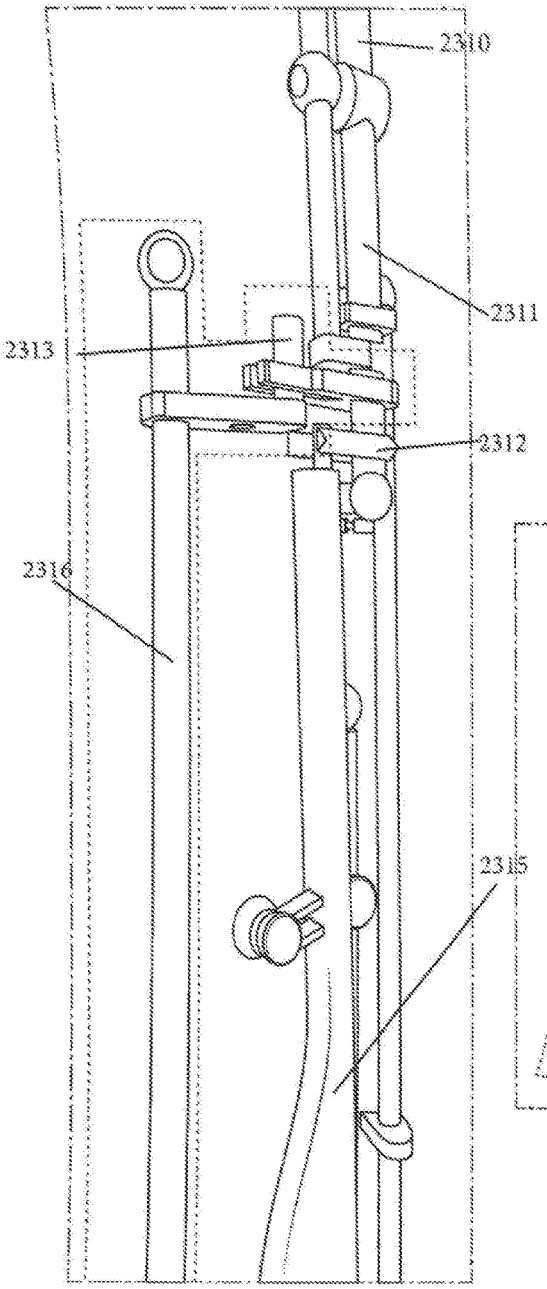
FIG. 4A is a zoom-in view of the register key 2310 and associated register key control spatula 2315.
Figure 4B:
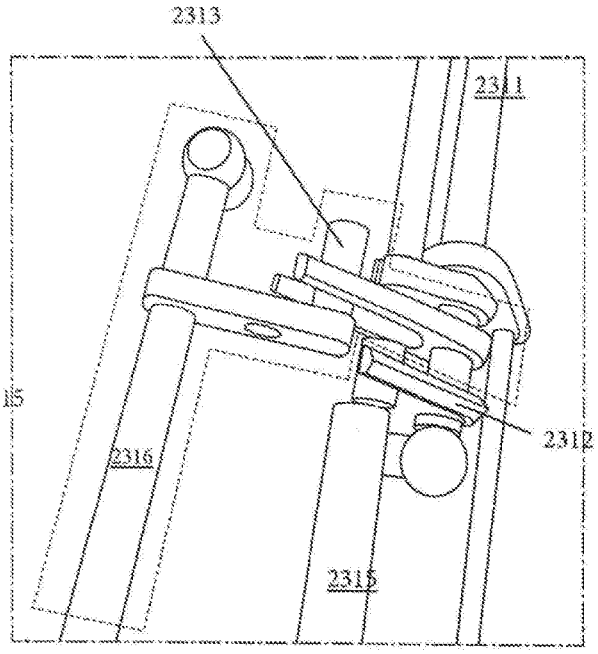
FIG. 4B is another zoom in view of the register key 2310 and associated register key control spatula 2315.

FIG. 4A is a zoom-in view of the register key 2310 and associated register key control spatula 2315. FIG. 4B is another zoom in view of the register key 2310 and associated register key control spatula 2315. As shown, in FIGS. 4A and 4B, a pivoting of the control spatula 2315 imparts motion to the control spatula motion transfer paddle 2312 which simultaneously imparts motion to the register key motion transfer paddle 2311 and the transfer paddle 2313 of the upper motion transfer rod 2316. Suitably, the motion of the control spatula 2311 manipulates the register key 2310 while, as discussed below, motion of the transfer paddle 2313 of the upper motion transfer rod 2316 manipulates the supplementary vent hole key 2320 (not shown in FIGS. 4A and 4B).

Figure 5:
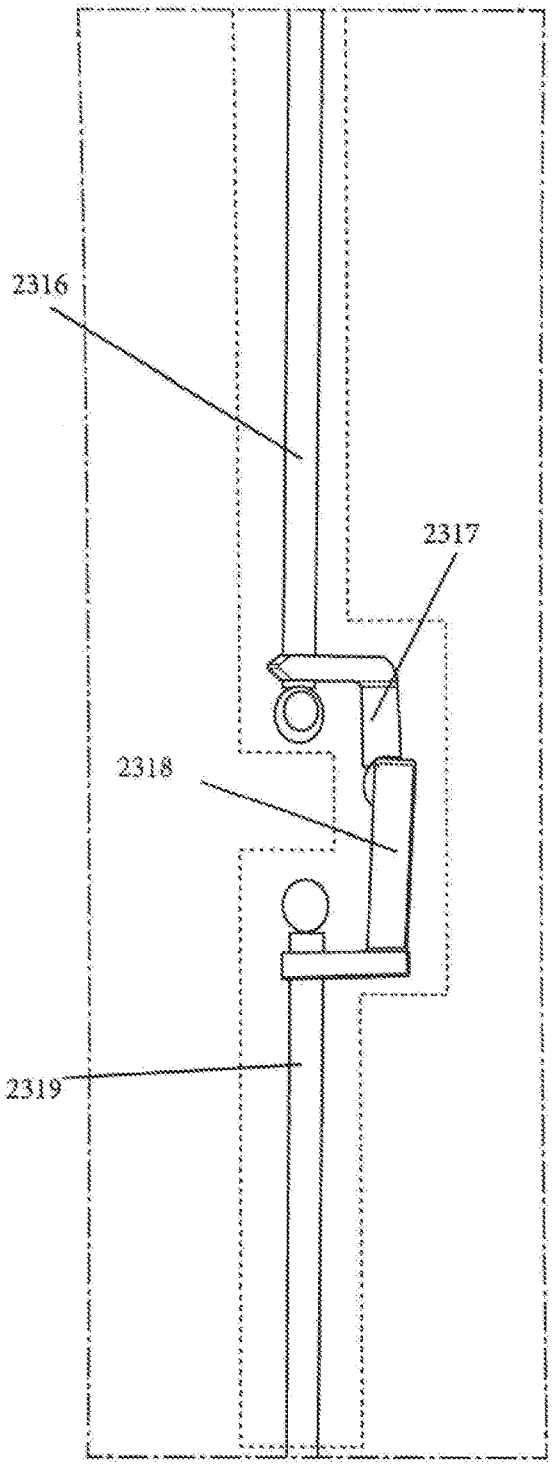
FIG. 5 is a zoom-in view of the interaction between the upper transfer paddle 2317 and the lower transfer paddle 2318 of the upper motion transfer rod 2316 and lower motion transfer rod 2319 respectively.

FIG. 5 is a zoom-in view of the interaction between the upper transfer paddle 2317 and the lower transfer paddle 2318 of the upper motion transfer rod 2316 and lower motion transfer rod 2319 respectively. Suitably, the upper and lower transfer paddles impart motion across the middle connection point 2225 (FIG. 3) wherein motion of the upper motion transfer rod 2316 is imparted to the lower motion transfer rod 2319.

Figure 6:
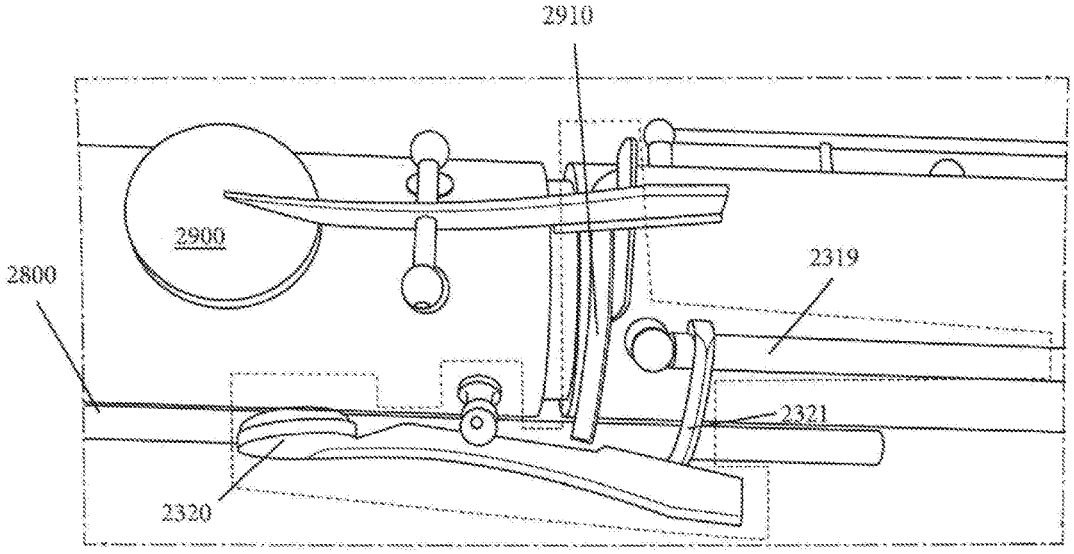
FIG. 6 is a zoom in view of the supplementary vent hole key 2320.
Figure 7:
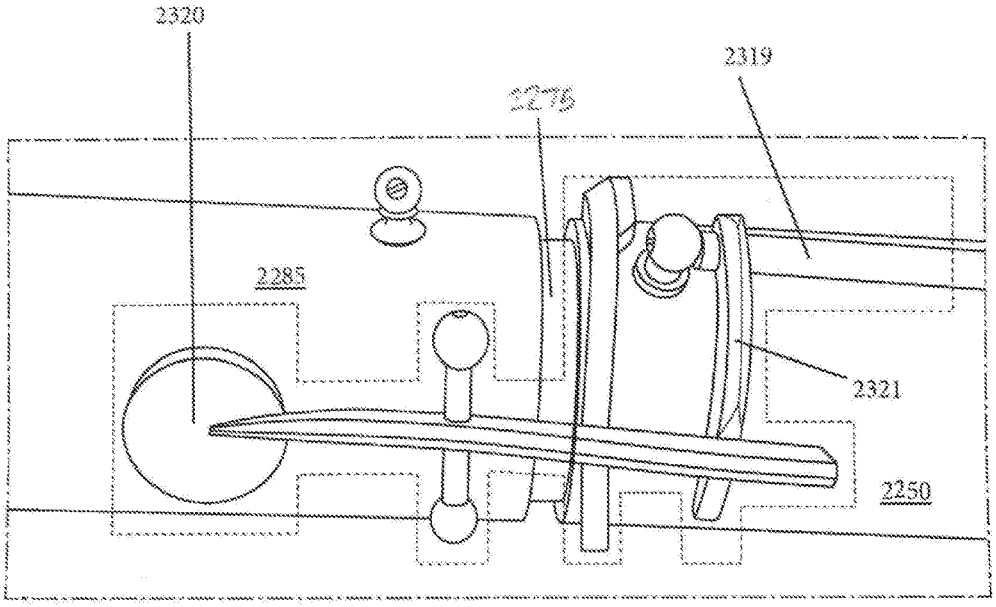
FIG. 7 is another zoom-in view of the supplementary vent hole key 2320.
Figure 8:
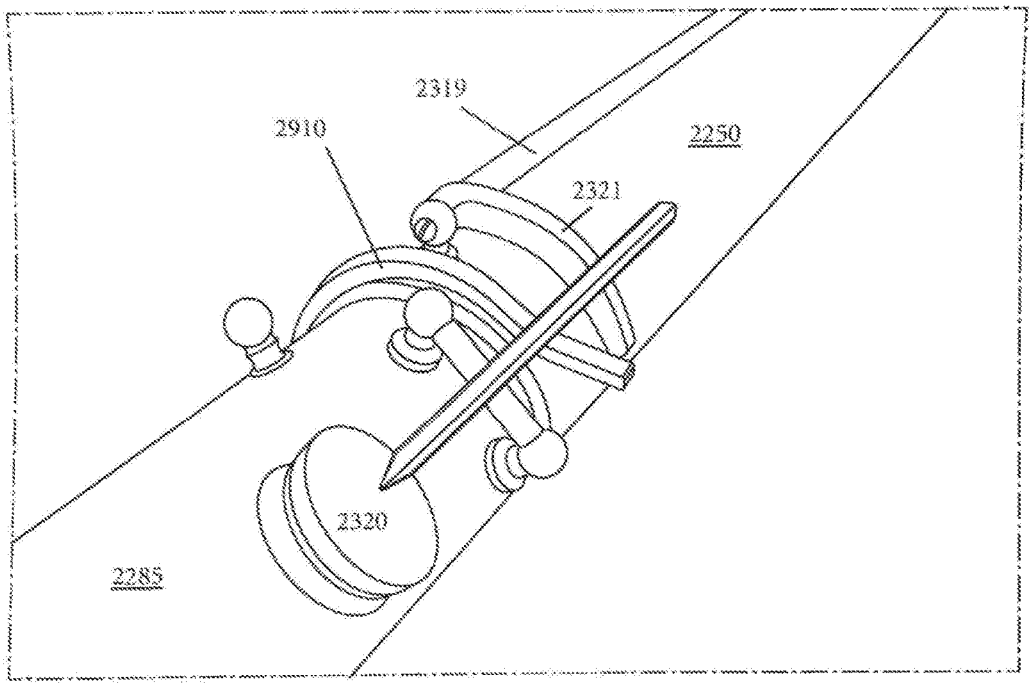
FIG. 8 is yet another zoom in view of the supplementary vent hole key 2320.
Figure 9:
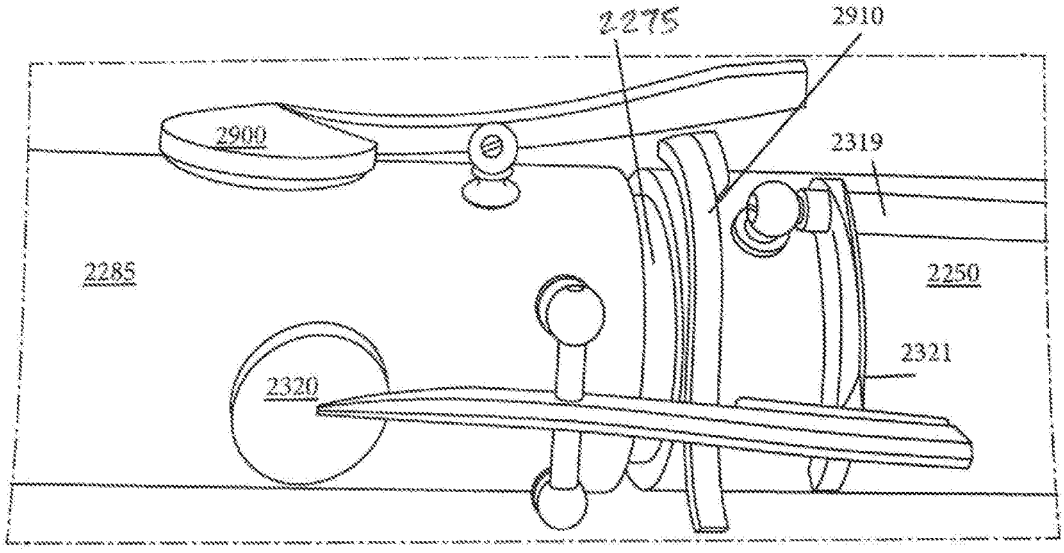
FIG. 9 is yet still another zoom-in view of the supplementary vent hole key 2320; and, FIG. 10 is yet even still another zoom in view of the supplementary vent hole key 2320.
Figure 10:
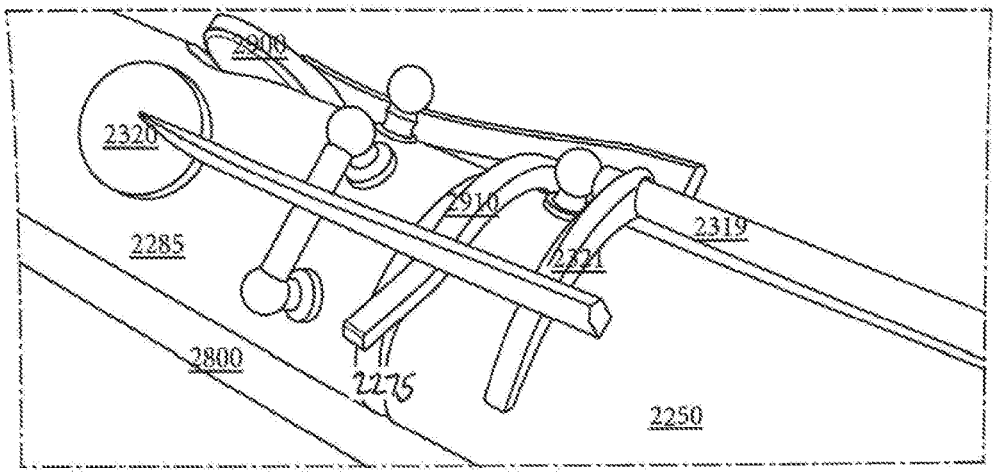

FIG. 6 is a zoom in view of the supplementary vent hole key 2320. FIG. 7 is another zoom-in view of the supplementary vent hole key 2320, where the view is rotated by ninety degrees relative to the view of FIG. 6. FIG. 8 is yet another zoom in view of the supplementary vent hole key 2320 where the view is rotated by ninety degrees relative to the view of FIG. 7. FIG. 9 is yet still another zoom-in view of the supplementary vent hole key 2320 where the view is rotated by ninety degrees relative to the view of FIG. 8. FIG. 10 is yet even still another zoom in view of the supplementary vent hole key 2320 where the view is rotated by ninety degrees relative to the view of FIG. 9. As shown in FIGS. 6 through 10, the supplementary vent hole key 2320 and its associated vent hole are provided through the lower joint 2285 just below the lower connection point 2195. Suitably, the lower motion transfer rod 2319 is provided with a supplementary vent hole key motion transfer paddle 2321 for imparting its rotary motion to a pivoting motion of the supplementary vent hole key 2320 over the associated vent hole. Suitably, the paddle 2321 is provided just above the lower connection point 2295 so that no motion transfer joints are required for manipulating the supplementary vent hole key 2310. Additionally, a low E-flat key motion transfer paddle 2910 is provided to the low E-flat key 2900 for imparting motion to the supplementary vent hole key 2320 over the associated vent hole. Suitably, the low E-flat key motion transfer paddle 2910 is provided just above the lower connection point 2295 so that no motion transfer joints are required for manipulating the supplementary vent hole key 2310. Suitably, a low E-flat key motion transfer paddle 2910 is provided to the control mechanisms of the low E-flat key 2900 for controlling the supplementary vent hole key. Preferably, the low E-flat key motion transfer paddle 2910 and motion transfer paddle 2321 represent automated mechanisms wherein the supplementary vent hole key 2320 is tied in to the register key 2310 or low E-flat key 2900 of the clarinet 2000 to facilitate seamless integration of the second key and vent to the clarinet without requiring extra effort on the part of the user, increased manufacturing costs for the instrument, or loss of efficacy of the instrument.

Although the method and apparatus is described above in terms of various exemplary embodiments and implementations, it should be understood that the various features, aspects and functionality described in one or more of the individual embodiments are not limited in their applicability to the particular embodiment with which they are described, but instead might be applied, alone or in various combinations, to one or more of the other embodiments of the disclosed method and apparatus, whether or not such embodiments are described and whether or not such features are presented as being a part of a described embodiment, such as the embodiment where middle joint 2250 and lower joint 2285 are replaced by a single joint of the approximate combined length of the two. Thus the breadth and scope of the claimed invention should not be limited by any of the above-described embodiments.

Terms and phrases used in this document, and variations thereof, unless otherwise expressly stated, should be construed as open-ended as opposed to limiting. As examples of the foregoing: the term "including" should be read as meaning "including, without limitation" or the like, the term "example" is used to provide exemplary instances of the item in discussion, not an exhaustive or limiting list thereof, the terms "a" or "an" should be read as meaning "at least one," "one or more," or the like, and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that might be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases might be absent. The use of the term "assembly" does not imply that the components or functionality described or claimed as part of the module are all configured in a common package. Indeed, any or all of the various components of a module, whether control logic or other components, might be combined in a single package or separately maintained and might further be distributed across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives might be implemented without confinement to the illustrated examples. For example, block diagrams and their accompanying description should not be construed as mandating a particular architecture or configuration.

All original claims submitted with this specification are incorporated by reference in their entirety as if fully set forth herein.

I claim:

1. A bass clarinet comprising:

a straight-bodied tube 2400 with (a) an upturned metal bell 2600 at one end and (b) a crook and a reeded mouthpiece 2100 at the other end;

keyed holes 2300 at various positions along the body 2400 where the keyed holes 2300 are provided such that musical notes are produced by passing air into the mouthpiece 2100, through the straight-bodied tube 2400, and out of the bell 2600;

wherein the clarinet 2000 is constructed of a neck 2700, an upper joint 2200, a middle joint 2250, a lower joint 2285 and the bell 2600;

wherein the mouthpiece 2100 is coupled to the neck 2700, the upper joint 1200 is connected to the middle joint 1250 at an upper connection point 2225, the middle joint 2250 is connected to the lower joint 2285 at a middle connection point 2275, the lower joint 2285 is connected to the bell 1600 at the lower connection point 2295;

a register key 2310 that closes or opens an associated vent tube via manipulation of the register key control spatula 2315; a supplementary vent hole key 2320 that closes or opens an associated supplementary vent hole positioned adjacent the bell 2600 and proximate a low E-flat key via either (a) the register key spatula 2315 or (b) a low E-flat key motion transfer paddle 2910 such that intonation is close to perfect (0 cents flat or sharp).

2. The bass clarinet of claim 1 where the register key 2310 and associated spatula 2315 for manipulating the register key 2310 is provided in the upper joint 2200 just below the neck 2700 while the lower joint 2285 features a low E-flat key 2900 and supplementary vent hole key 2320 just below the lower connection point 2275.

3. The bass clarinet of claim 2 further comprising a motion transfer rod 2316; 2319 along the instrument to connect the control of register key 2310 and supplementary vent hole key 2320 to the register control spatula 1315.

4. The bass clarinet of claim 3 further comprising a low E-flat key motion transfer paddle 2910 is provided to the control mechanisms of the low E-flat key 2900 for controlling the lower register key.

* * * * *